US008239999B2

(12) United States Patent
Hsu

(10) Patent No.: US 8,239,999 B2
(45) Date of Patent: Aug. 14, 2012

(54) MOP ASSEMBLY WITH STEAM GENERATION DEVICE

(76) Inventor: Pet-Cheng Hsu, Shinjuang (TW)

( * ) Notice: Subject to any disclaimer, the term of this patent is extended or adjusted under 35 U.S.C. 154(b) by 654 days.

(21) Appl. No.: 12/457,668

(22) Filed: Jun. 18, 2009

(65) Prior Publication Data

US 2010/0319156 A1 Dec. 23, 2010

(51) Int. Cl.
*A47L 5/00* (2006.01)
*A47L 7/00* (2006.01)

(52) U.S. Cl. ..... 15/320; 15/328; 15/329; 15/331; 15/339; 15/344; 15/403; 15/49.1; 15/98

(58) Field of Classification Search ..... 15/320, 15/328, 329, 331, 339, 344, 403, 49.1, 98; *A47L 5/00, 7/00, 9/00, 11/00*
See application file for complete search history.

(56) References Cited

U.S. PATENT DOCUMENTS

| | | | | |
|---|---|---|---|---|
| 6,571,421 | B1 * | 6/2003 | Sham et al. | 15/320 |
| 7,163,349 | B2 * | 1/2007 | Policicchio et al. | 401/137 |
| 7,266,292 | B1 * | 9/2007 | Tsai | 392/465 |
| 2010/0050367 | A1 * | 3/2010 | Tsai | 15/320 |

* cited by examiner

*Primary Examiner* — David Redding

(57) ABSTRACT

A mop assembly includes a handle having a control member connected to a lower end thereof and the control member is located within a connection unit which is connected to the handle. A locking unit is connected to outside of the connection unit and is hooked to a main body. The main body includes a case in which a tank, a steam generation device and a pivotal member are located therein. An operation bar is pivotably connected to the case. The pivotal member is able to activate the steam generation device by pushing the handle downward. The main body can be disengaged from the locking unit and used individually. The steam generation device can be activated by operation of an operation bar on the main body.

5 Claims, 7 Drawing Sheets

MOP ASSEMBLY WITH STEAM GENERATION DEVICE

BACKGROUND OF THE INVENTION (1) Field of the Invention

The present invention intends to provide a mop assembly with a steam generation device received therein and the steam generation device can be removed from the main case of the mop assembly and used individually.

(2) Description of the Prior Art

A conventional mop assembly with steam is shown in FIG. 7 and generally includes a handle 80, a main body 82 connected to the handle 80, a mop unit 81 connected to the lower end of the main body 82, a pump 84, a water tank 83 and a steam generation device 85. The pump 84, the water tank 83 and the steam generation device 85 are received in the main body 82 and connected with each other by hoses. When the user pushes the handle 80 downward to activate the pump 84, the steam is generated by the steam generation device 85 and ejected to the floor to melt the stain or dirty spots, and the mop unit 81 can easily mop the floor to clean the floor. The stream is generated at high temperature which kills germs as well.

Nevertheless, the steam generation device is received in the main body of the conventional mop assembly and cannot be used in different ways and this arrangement of the steam generation device restricts the use of the steam generation device and the conventional mop assembly.

The present invention intends to provide a mop assembly with a steam generation device received therein and the steam generation device can be removed from the main case of the mop assembly and used individually.

SUMMARY OF THE INVENTION

The present invention relates to a mop assembly which comprises a handle has a control member connected to a lower end thereof and the control member includes a protrusion. The lower end of the handle and the control member are axially connected to a connection unit. A locking unit is connected to outside of the connection unit and axially movable relative to the connection unit. The locking unit has a hook on a lower end thereof so as to hook a main body. The main body includes a case in which a tank, a steam generation device and a pivotal member are located. An operation bar is pivotably connected to the case. The pivotal member has a first end which contacts the protrusion of the control member, and a second end of the pivotal member contacts a first valve which is operatively connected to the tank and the steam generation device. The pivotal member is pivoted by pushing the handle to activate the steam generation device when the main body is connected to the connection unit.

The operation bar has a first end located in the case and contacts a second valve and a second end of the operation bar is exposed from the case. The second valve is operatively connected to the tank and the steam generation device which is activated by operation on the second end of the operation bar when the main body is individually used.

The primary object of the present invention is to provide a mop assembly wherein the steam generation device is activated by pushing the handle so that steam ejects from the mop case to dissolve rough dirty stain on the floor.

Another object of the present invention is to provide a steam generation device which can be disengaged from the mop assembly and used individually. The steam generation device is activated by pushing an operation bar on the main body.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENTS

Figure 1:
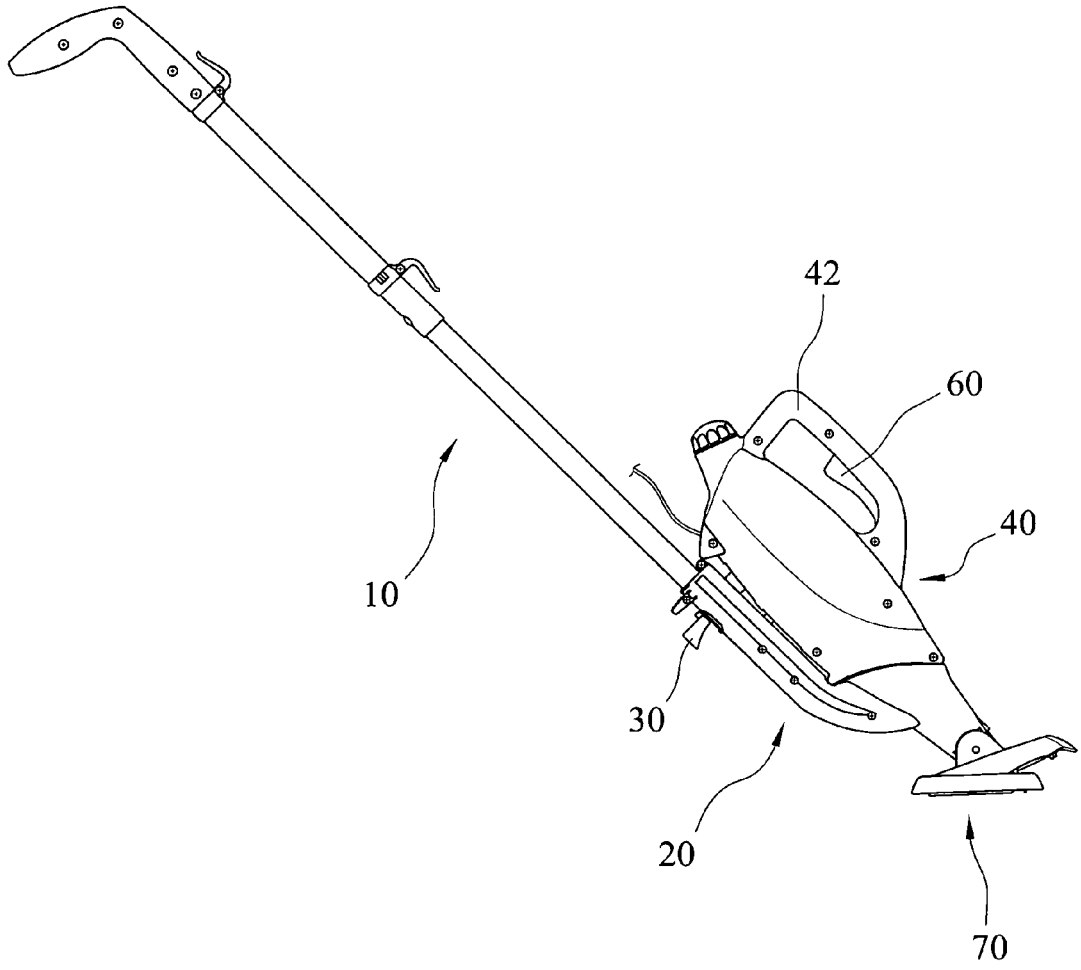
FIG. 1 is a perspective view to show the mop assembly of the present invention.
Figure 2:
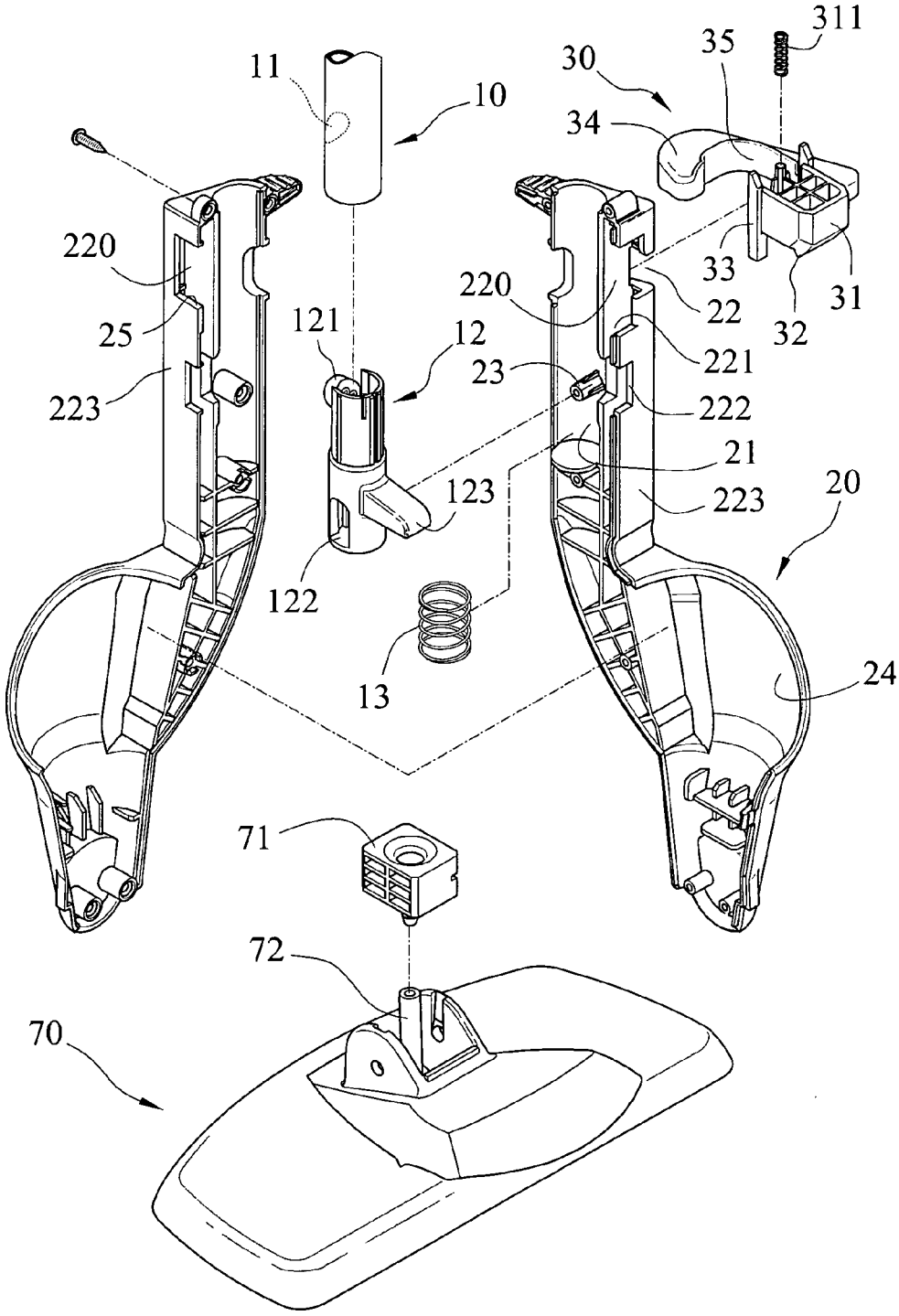
FIG. 2 is an exploded view to show the handle, the control member, the connection unit and the mop case of the mop assembly of the present invention.
Figure 3:
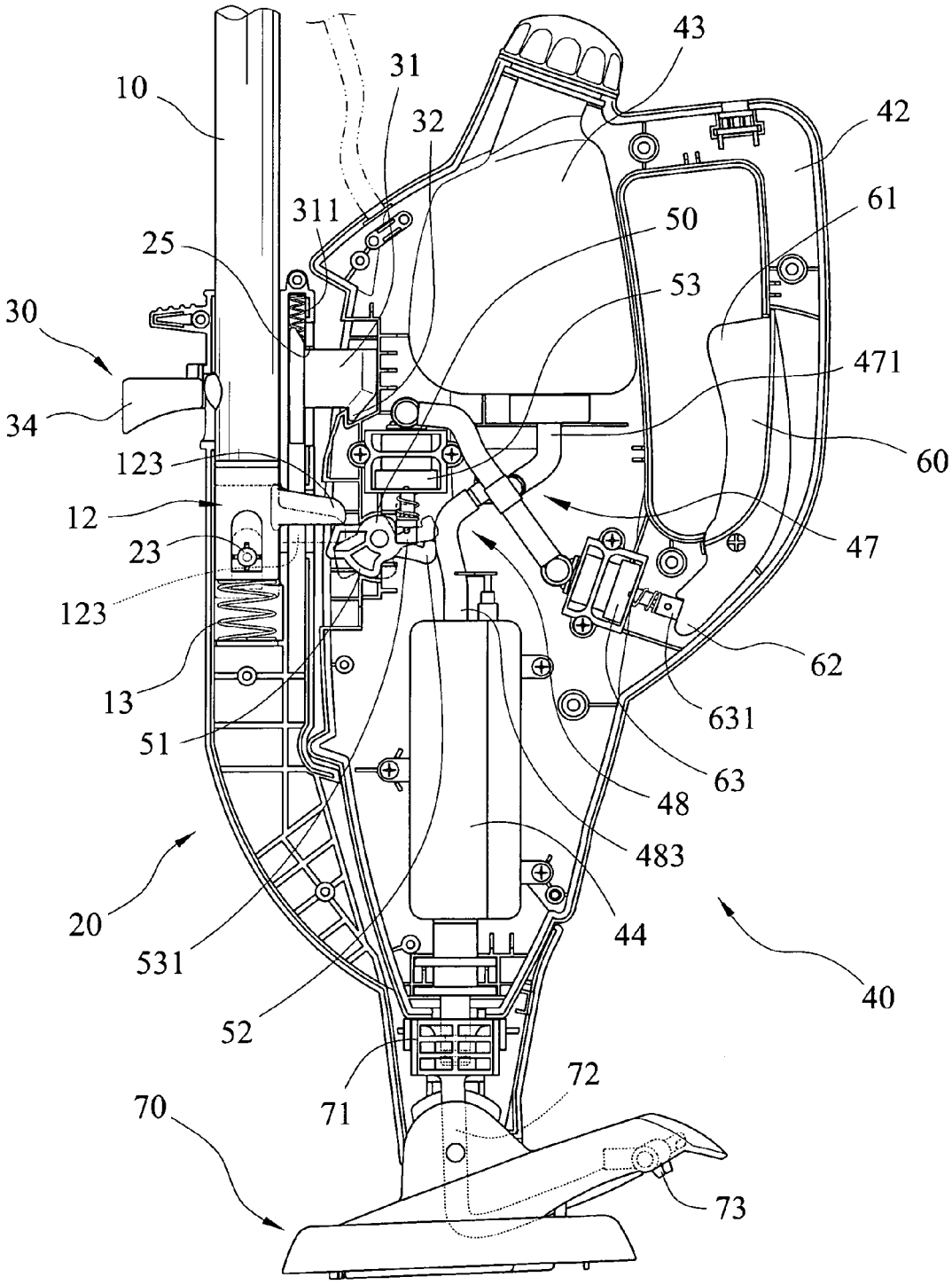
FIG. 3 is a side view to show the mop assembly of the present invention.
Figure 4:
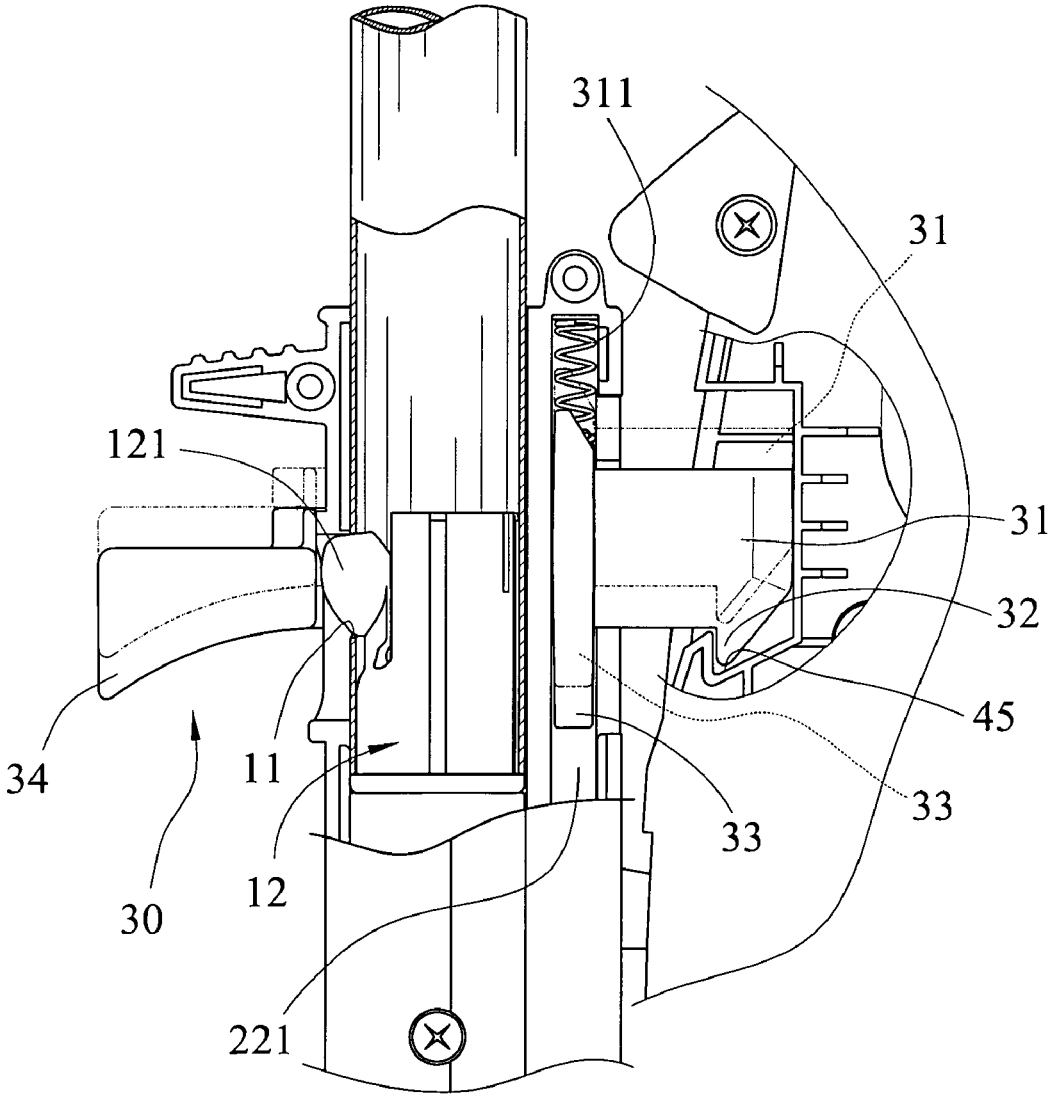
FIG. 4 shows that the locking unit connects the connection unit and the main body of the mop assembly of the present invention.
Figure 5:
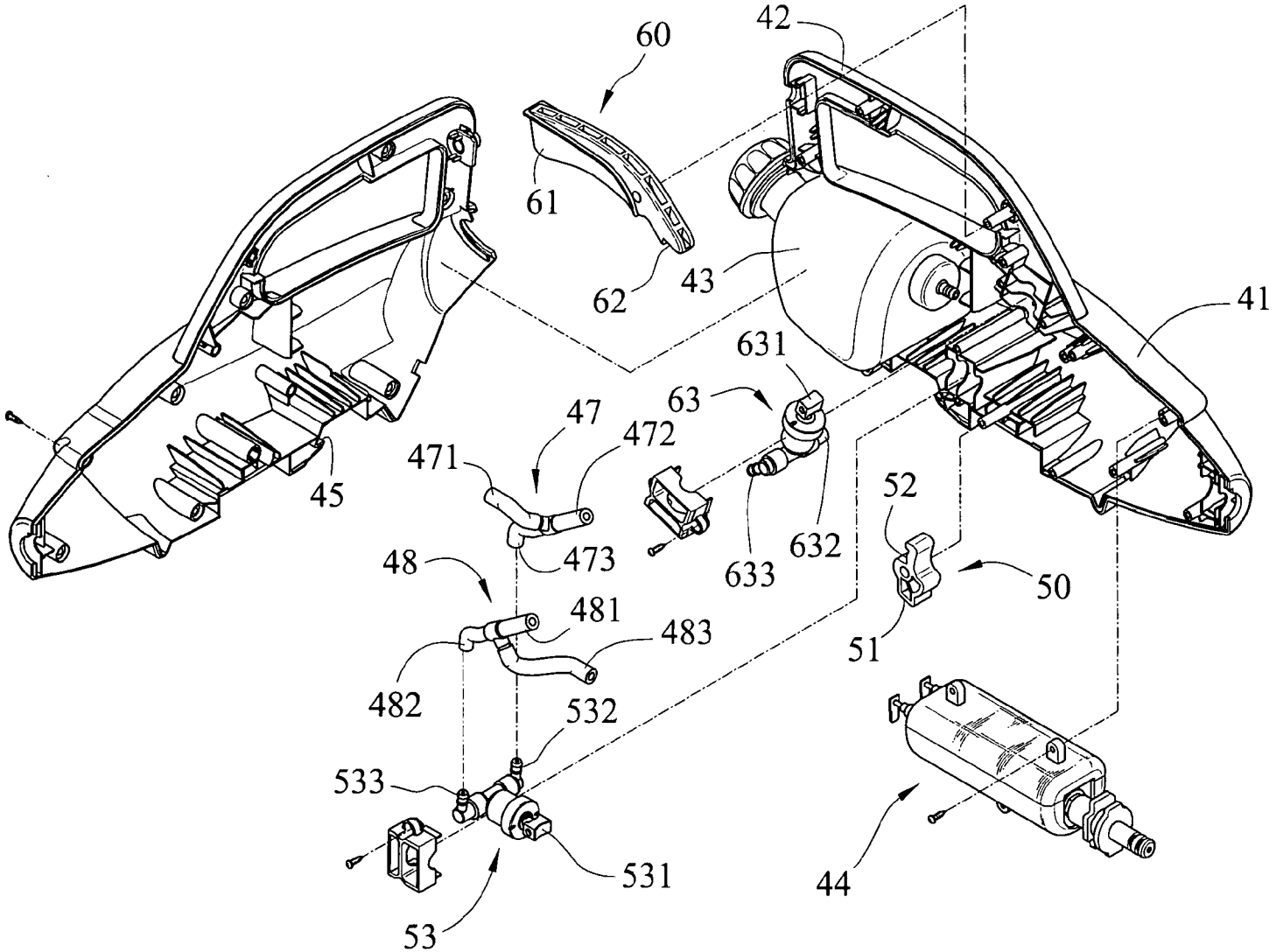
FIG. 5 is an exploded view to show the tank, the steam generation device and the valves in the case of the main body of the mop assembly of the present invention.

Referring to FIGS. 1 to 5, the mop assembly of the present invention comprises a retractable handle 10 has a through hole 11 defined through a lower end thereof and a control member 12 includes a connection portion 121 which is engaged with the through hole 11 so that the control member 12 is connected to the lower end of the handle 10. The control member 12 includes a protrusion 123 extending radially therefrom and an elongate hole 122 is defined through a lower end of the control member 12. The lower end of the handle 10 and the control member 12 are axially connected to a connection unit 20. A spring 13 is biased at an underside of the control member 12 so as to provide the control member 12 to bounce upward.

The connection unit 20 is composed of two halves and includes an inner wall 220 and an outer wall 223. An axial passage 21 is defined in the connection unit 20 and enclosed by the inner wall 220. The handle 10 and the control member 12 are received in the axial passage 21. An insertion hole 24 is defined in the inner wall 220 and a snapping hole 22 is defined in the outer wall 223. A slit 221 is defined and communicates with the snapping hole 22 and located between the inner and outer walls 220, 223. A first side hole 222 is located below the slit 221 and defined through the inner and outer walls 220, 223. A rod 23 extends from an inside of the axial passage 21 and through the elongate hole 122. A bolt extends through the rod 23 and is connected to the connection unit 20. A second side hole 25 is located above the first side hole 222 and defined through the outer wall 223. The protrusion 123 extends out from the first side hole 222. The handle 10 and the protrusion 123 are movable along the first side hole 222.

A locking unit 30 is connected to outside of the connection unit 20 and axially movable relative to the connection unit 20. The locking unit 30 includes a base 31, an insertion 33, a block 34 and a spring 311. A hook 32 is located at an underside of the base 31 and the block 34 extends from the base 31 so as to define a space 35 between the base 31 and the block 34. The space 35 includes an opening and located between the insertion 33 and a distal end of the block 34. The block 34 is located outside of the connection unit 20 which is partially located with in the space 35. The hook 32 is hooked with a main body 40. The spring 311 is biased between the slit 221 and the insertion 33. The locking unit 30 is movable relative to the connection unit 20, the base 31 and the hook 32 extend through the second side hole 25.

The main body 40 including a case 41 in which a tank 43, a steam generation device 44 and a pivotal member 50 are located. An operation bar 60 is pivotably connected to the case 41. The case 41 has a groove 45 with which the hook 32 of the locking unit 30 is engaged. A portion of the case 41 is inserted into the insertion hole 24 of the connection unit 20.

The pivotal member 50 has a first end 51 which contacts the protrusion 123 of the control member 12 and a second end 52 of the pivotal member 50 contacts a first valve 53 which is operatively connected to the tank 43 and the steam generation device 44. The operation bar 60 is an elongate bar and has a second end 62 located in the handle 42 and contacting a second valve 63 and a first end 61 of the operation bar 60 is exposed from the handle 42. The second valve 63 is operatively connected to the tank 43 and the steam generation device 44 which is activated by operation on the second end 62 of the operation bar 60.

The first and second valves 53, 63 both are three-way valves and each have a contact end 531/631, a first end 532/632 and a second end 533/633. The first and second valves 53, 63 are fixed to the case 41 and second end 52 of the pivotal member 50 contacts the contact end 531 of the first valve 53 and the second end 62 of the operation bar 60 contacts the contact end 631 of the second valve 63. A first pipe 47 has a first end 471 thereof connected to the outlet of the tank 43 and a second end 472 of the first pipe 47 is connected to the first end 632 of the second valve 63. A third end 473 of the first pipe 47 is connected to the first end 532 of the first valve 53.

A second pipe 48 has a first end 481 thereof connected to the second end 633 of the second valve 63 and a second end 482 of the second pipe 48 is connected to the second end 533 of the first valve 53. A third end 483 of the second pipe 48 is connected to the inlet of the steam generation device 44. An adapter 71 is connected between a hose 72 of a mop case 70 and the steam generation device 44. The hose 72 is connected to a nozzle 73 which is located on the mop case 70.

When the main body 40 is connected to the connection unit 20 by the locking unit 30, the user can push the handle 10 downward such that the mop case 70 is moved on the floor and the protrusion 123 of the control member 12 pivots the pivotal member 50 which pushes the contact end 531 to activate the first valve 53 and the water in the tank 43 is sucked out and enters into the steam generation device 44 via the second valve 63 and the first pipe 47. The water is heated and transferred into steam which ejects out from the nozzle 73 via the hose 72. The high temperature of the steam dissolves the rough dirty stain on the floor and the mop case 70 can easily remove the stain. The high temperature of the steam can kill the germs as well.

Figure 6:
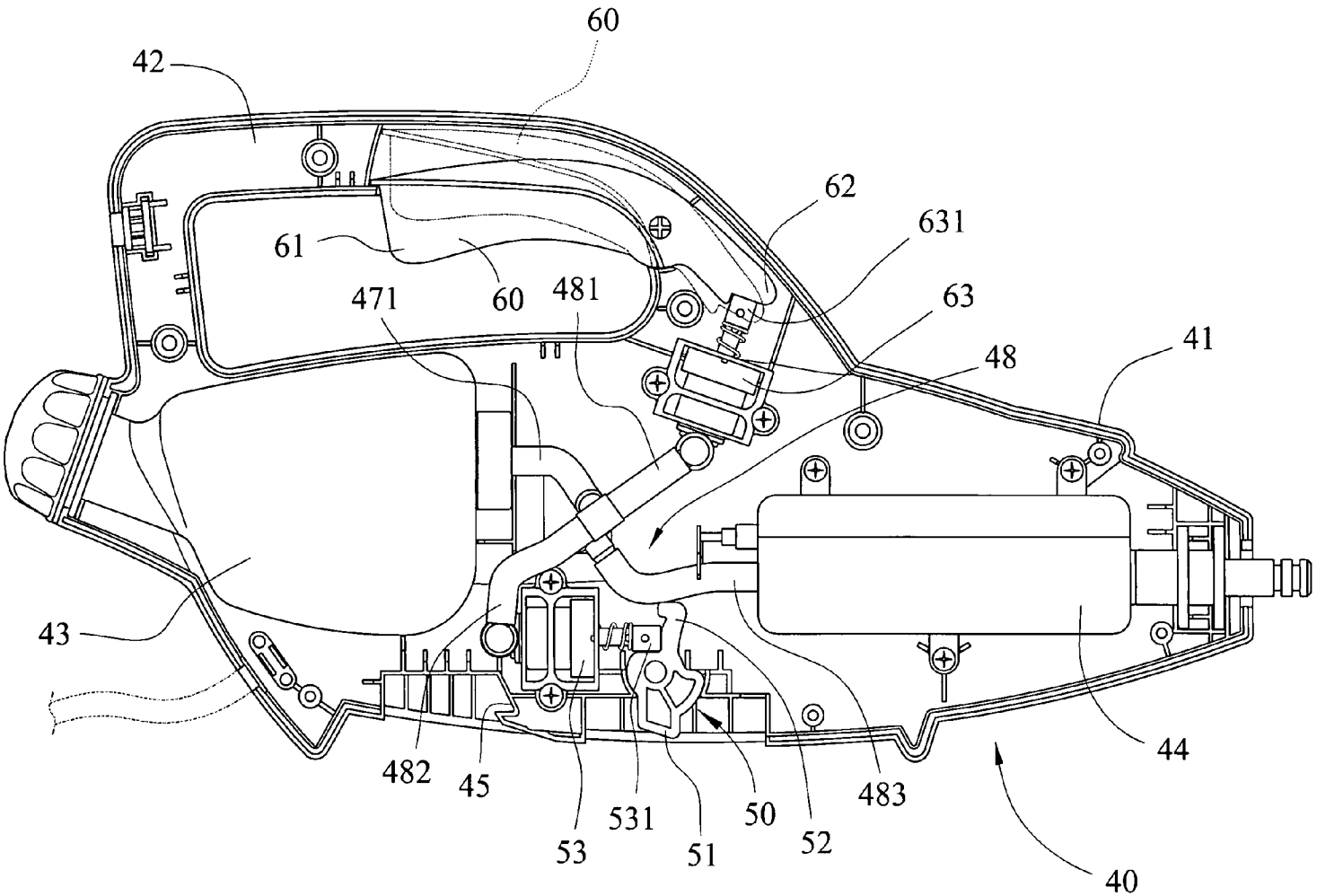
FIG. 6 shows the structure of the main body which is disengaged from the connection unit.
Figure 7:
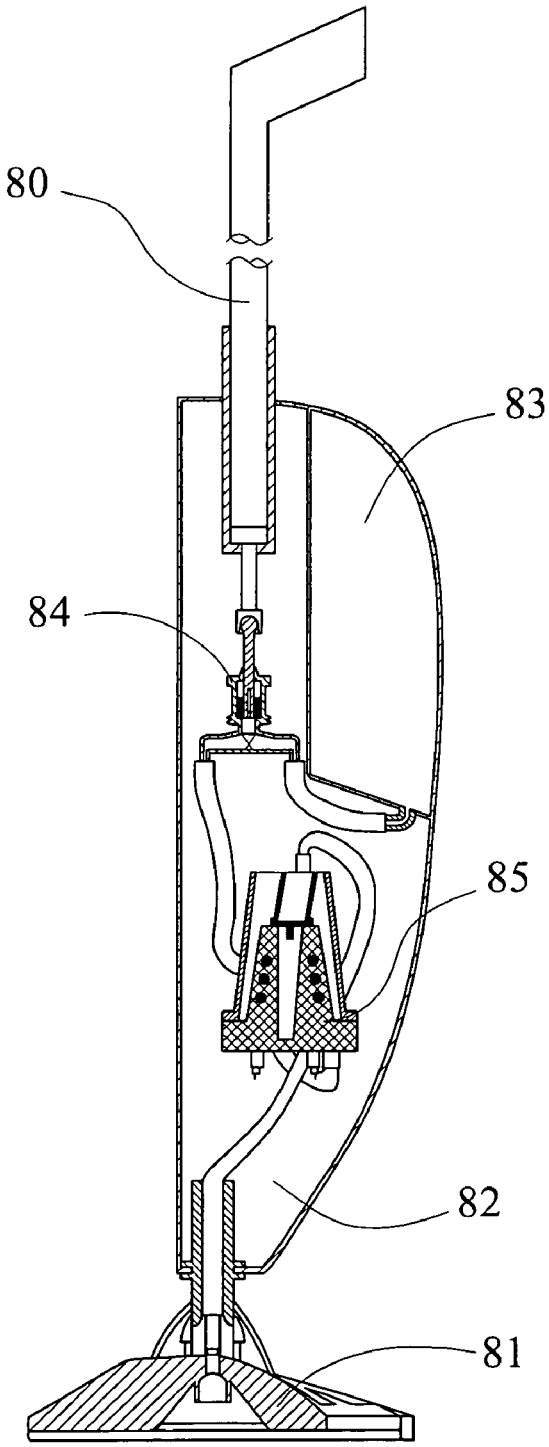
Fig 7 ( Prior Art )
FIG. 7 is a partial cross sectional view to show a conventional mop with steam generation device.

When the main body 40 is individually used, the user simply pushes the block 34 of the locking unit 30 to disengage the hook 32 from the groove 45, the main body 40 is separated from the connection unit 20 and can be pulled out from the insertion hole 24. As shown in FIG. 6, the user pushes the first end 61 of the operation bar 60, the second end 62 of the operation bar 60 activates the second valve 63 and the water in the tank 43 is sucked and enters into the steam generation device 44 via the second valve 63, the first pipe 47 and the second pipe 48. The steam ejects from the outlet tube of the main body 40.

While we have shown and described the embodiment in accordance with the present invention, it should be clear to those skilled in the art that further embodiments may be made without departing from the scope of the present invention.

What is claimed is:

1. A mop assembly comprising:

a handle having a control member connected to a lower end thereof and the control member including a protrusion extending radially therefrom, the lower end of the handle and the control member axially connected to a connection unit;

a locking unit connected to outside of the connection unit and axially movable relative to the connection unit, the locking unit having a hook on a lower end thereof;

a main body including a case in which a tank, a steam generation device and a pivotal member are located, an operation bar pivotably connected to the case, the case having a groove with which the hook of the locking unit is engaged, a portion of the case being inserted into the insertion hole of the connection unit, and the pivotal member having a first end which contacts the protrusion of the control member, a second end of the pivotal member contacting a first valve which is operatively connected to the tank and the steam generation device, the pivotal member being pivoted by pushing the handle to activate the steam generation device, the operation bar having a first end located in the case and contacting a second valve and a second end of the operation bar exposed from the case, the second valve operatively connected to the tank and the steam generation device which is activated by operation on the second end of the operation bar.

2. The assembly as claimed in claim 1, wherein the control member includes an elongate hole defined therein and a spring is biased at an underside of the control member, the connection unit is composed of two halves and includes an inner wall and an outer wall, an axial passage is defined in the connection unit and enclosed by the inner wall, the handle and the control member are received in the axial passage, an insertion hole is defined in the inner wall and a snapping hole is defined in the outer wall, a slit is defined and communicates with the snapping hole and located between the inner and outer walls, a first side hole is located below the slit and defined through the inner and outer walls, a rod extends from an inside of the axial passage and through the elongate hole, a bolt extends through the rod and connected to the connection unit, a second side hole is located above the first side hole and defined through the outer wall, the protrusion extends out from the first side hole, the handle and the protrusion are movable along the first side hole.

3. The assembly as claimed in claim 1, wherein the locking unit includes a base, an insertion, a block and a spring, the hook is located at an underside of the base and the block extends from the base so as to define a space between the base and the block, the space includes an opening and located between the insertion and a distal end of the block, the block is located outside of the connection unit which is partially located with in the space, the spring is biased between the slit and the insertion, the locking unit is movable relative to the connection unit and the base and the hook extend through the second side hole.

4. The assembly as claimed in claim 1, wherein the operation bar on the main body is an elongate bar.

5. The assembly as claimed in claim 1, wherein the first and second valves both are three-way valves and each have a contact end, a first end and a second end, the first and second valves are fixed to the case and second end of the pivotal member contacts the contact end of the first valve and the first end of the operation bar contacts the contact end of the second valve, a first pipe has a first end thereof connected to the tank and a second end of the first pipe is connected to the first end of the second valve, a third end of the first pipe is connected to the first end of the first valve, a second pipe has a first end thereof connected to the second end of the second valve, a second end of the second pipe is connected to the second end of the first valve, a third end of the second pipe is connected to the steam generation device, an adapter is connected between a hose of a mop case and the steam generation device, the hose is connected to a nozzle which is located on the mop case.

* * * * *